US009360159B2

(12) United States Patent
Gazeau

(10) Patent No.: US 9,360,159 B2
(45) Date of Patent: Jun. 7, 2016

(54) FLUIDTIGHT AND THERMALLY INSULATING TANK

(71) Applicant: GAZTRANSPORT ET TECHNIGAZ, Saint Remy les Chevreuse (FR)

(72) Inventor: James Gazeau, La Mothe Achard (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 0 days.

(21) Appl. No.: 14/405,131

(22) PCT Filed: Jun. 4, 2013

(86) PCT No.: PCT/FR2013/051258

§ 371 (c)(1),
(2) Date: Dec. 2, 2014

(87) PCT Pub. No.: WO2013/186458

PCT Pub. Date: Dec. 19, 2013

(65) Prior Publication Data

US 2015/0167894 A1 Jun. 18, 2015

(30) Foreign Application Priority Data

Jun. 11, 2012 (FR) ..... 12 55435

(51) Int. Cl.
*B63B 25/16* (2006.01)
*B63B 27/30* (2006.01)
(Continued)

(52) U.S. Cl.
CPC ..... *F17C 3/025* (2013.01); *B63B 25/16* (2013.01); *B63B 27/30* (2013.01); *F17C 3/027* (2013.01);
(Continued)

(58) Field of Classification Search
CPC ..... B63B 25/16; B63B 25/14; B63B 27/30; F17C 3/025; F17C 3/027; F17C 3/04
USPC ..... 114/74 A; 52/410; 220/560.07, 560.11, 220/560.12, 592.26
See application file for complete search history.

(56) References Cited

U.S. PATENT DOCUMENTS 6,035,795 A * 3/2000 Dhellemmes ..... B63B 25/16 114/74 A
6,374,761 B1 * 4/2002 Dhellemmes ..... B63B 3/68 114/74 A
7,171,916 B2 * 2/2007 Yang ..... B63B 3/68 114/74 A

FOREIGN PATENT DOCUMENTS

EP 0064886 A1 11/1982
FR 2739675 A1 4/1997

OTHER PUBLICATIONS

International Preliminary Report and Written Opinion of the Searching Authority for PCT/FR2013/051258, Dec. 16, 2014.
(Continued)

*Primary Examiner* — Lars A Olson
(74) *Attorney, Agent, or Firm* — Notaro, Michalos & Zaccaria P.C.

(57) ABSTRACT

A fluidtight and thermally insulating tank wall comprises: a multi-layer structure comprising a fluidtight barrier (5) and a thermally insulating barrier (4), retaining rods (22) attached to the bearing wall (7) between the insulating elements and extending in the direction of the thickness of the multi-layer structure to hold the multi-layer structure on the bearing wall, in which crossmembers (30) are attached to the retaining rods (22) such that in each instance a crossmember extends between two retaining rods at the interface between two insulating elements, the cover panels (11) of the insulating elements being connected to the crossmembers (30) so as to be held against the bearing wall via the crossmembers, and the fluidtight barrier (5) being connected to the crossmembers (30) so as to be held against the cover panels of the insulating elements via the crossmembers.

17 Claims, 4 Drawing Sheets

(51) Int. Cl.
*F17C 3/02* (2006.01)
*F17C 3/04* (2006.01)

(52) U.S. Cl.
CPC ..... *F17C 3/04* (2013.01); *F17C 2201/0157* (2013.01); *F17C 2201/052* (2013.01); *F17C 2203/0354* (2013.01); *F17C 2203/0358* (2013.01); *F17C 2203/0631* (2013.01); *F17C 2203/0639* (2013.01); *F17C 2203/0678* (2013.01); *F17C 2205/0364* (2013.01); *F17C 2221/033* (2013.01); *F17C 2223/0161* (2013.01); *F17C 2223/033* (2013.01); *F17C 2260/013* (2013.01); *F17C 2270/0107* (2013.01); *F17C 2270/0113* (2013.01); *F17C 2270/0121* (2013.01); *F17C 2270/0136* (2013.01)

(56) References Cited

OTHER PUBLICATIONS http://www.re-steel.com/wp-content/uploads/2013/08/ReSteel_DataSheet_Invar36.pdf.

* cited by examiner

FLUIDTIGHT AND THERMALLY INSULATING TANK

The invention relates to the field of fluidtight and thermally insulating tanks and the methods of manufacturing same. In particular, the invention relates to an on-shore tank for the storage of liquefied gases, particularly liquefied natural gas that has a high methane content.

Such an on-shore tank is disclosed for example in FR-A-2739675. Also known are liquefied gas storage tanks that are present in the bearing structure of a ship. A ship's tank such as this is disclosed for example in EP-A-0064886.

According to one embodiment, the invention provides a fluidtight and thermally insulating tank built into a bearing structure to contain a fluid, in which one wall of the tank comprises:

a bearing wall of the bearing structure, a multi-layer structure comprising a fluidtight barrier and a thermally insulating barrier which is arranged between the fluidtight barrier and the bearing wall, the thermally insulating barrier comprising juxtaposed insulating elements, an insulating element including:

thermally insulating lagging material arranged in the form of a layer parallel to the bearing wall, bearing elements which rise up through the thickness of the thermally insulating lagging material to react compressive loads, and a cover panel placed on the bearing elements and having a support surface parallel to the bearing wall for supporting the fluidtight barrier, and retaining rods attached to the bearing wall between the insulating elements and extending in the direction of the thickness of the multi-layer structure to hold the multi-layer structure on the bearing wall, in which crossmembers are attached to the retaining rods such that in each instance a crossmember extends between two retaining rods at the interface between two insulating elements, the cover panels that cover the insulating elements being connected to the crossmembers so as to be held against the bearing wall via the crossmembers, and the fluidtight barrier being connected to the crossmembers so as to be held against the cover panels that cover the insulating elements via the crossmembers.

Such a tank may also have one or more of the following features, depending on the embodiment.

According to one embodiment, an anchor plate is connected with the crossmember so as to lie flush with the cover panel of an adjacent insulating element, the anchor plate having a lower surface which bears against the cover panel and an upper surface on which the fluidtight barrier is placed.

According to one embodiment, the anchor plate protrudes in each side of the crossmember parallel to the bearing wall so as to collaborate with the cover panels of the two insulating elements between which the crossmember is arranged.

According to one embodiment, the anchor plate is arranged midway between the two retaining rods to which the crossmember is attached.

According to one embodiment, the fluidtight barrier comprises a metallic membrane having corrugations and flat parts situated between the corrugations, the anchor plates being made of metal, the metallic membrane being welded to the anchor plates at the flat parts.

According to one embodiment, the retaining rods are arranged in such a way as to form a plurality of parallel rows on the bearing wall, and in which the crossmembers which extend between the retaining rods of one row each bear an elongate weld support which protrudes at right angles to the bearing wall between the cover panels of the insulating elements adjacent to the row of retaining rods, and in which the fluidtight barrier comprises a metallic membrane made of a steel with a low coefficient of expansion which is made up of flat strips of sheet metal arranged on the cover panels of the insulating elements and having edges that are turned up towards the inside of the tank, the turned-up edges of the strips of sheet metal being welded continuously to the elongate weld supports to form deformable gussets capable of deforming in a direction transverse to the elongate weld supports.

According to one embodiment, the multi-layer structure constitutes a primary barrier of the tank, the tank wall further comprising a second multi-layer structure arranged between the first multi-layer structure and the bearing wall, the second multi-layer structure comprising a secondary fluidtight barrier and a secondary thermally insulating barrier which is arranged between the secondary fluidtight barrier and the bearing wall, and in which the insulating elements of the primary barrier bear against the secondary fluidtight barrier.

Such a secondary barrier of the tank can be constructed with a structure identical to the primary barrier described hereinabove, or with a different structure.

According to one embodiment, the secondary insulating barrier comprises juxtaposed secondary insulating elements, a secondary insulating element including:

thermally insulating lagging material arranged in the form of a layer parallel to the bearing wall, bearing elements which rise up through the thickness of the thermally insulating lagging material to react compressive loads, and a cover panel placed on the bearing elements and having a support surface parallel to the bearing wall for supporting the secondary fluidtight barrier, and in which the retaining rods attached to the bearing wall extend between the secondary insulating elements in the direction of the thickness of the second multi-layer structure to hold the second multi-layer structure also on the bearing wall, in which secondary crossmembers are attached to the retaining rods such that in each instance a secondary crossmember extends between two retaining rods at the interface between two secondary insulating elements, the cover panels of the secondary insulating elements being connected to the secondary crossmembers so as to be held against the bearing wall via the secondary crossmembers, and the secondary fluidtight barrier being connected to the secondary crossmembers so as to be held against the cover panels of the secondary insulating elements via the secondary crossmembers, the secondary fluidtight barrier having the retaining rods attached to the bearing wall passing through it and having fluidtight connections around the retaining rods.

According to another embodiment, the multi-layer structure constitutes a secondary barrier of the tank, the tank wall further comprising a second multi-layer structure arranged on the first multi-layer structure on the opposite side to the bearing wall, the second multi-layer structure comprising a primary fluidtight barrier and a primary thermal insulation barrier which is arranged between the primary fluidtight barrier and the secondary fluidtight barrier.

Such a primary barrier of the tank may be constructed with a structure identical to the secondary barrier described hereinabove or with a different structure.

According to one embodiment, the secondary fluidtight barrier is made of a composite material comprising a metal foil and a fibreglass mat bonded to the metal foil by a polymer resin.

According to one embodiment, a retaining rod bears a crossmember connector arranged at a level lower down than the cover panels of the insulating elements, the crossmember connector comprising several fasteners arranged around the retaining rod to collaborate with complementary fasteners arranged at the ends of the crossmembers.

According to one embodiment, the fasteners of the crossmember connector are male plugs that fit into housings formed at the ends of the crossmembers and are held in these housings by pins.

According to one embodiment, the bearing elements comprise posts, the cross section of which is small by comparison with the dimensions of the insulating element.

According to one embodiment, the thermally insulating lagging comprises a flexible insulating substance, for example glass wool. According to one embodiment, the bearing elements and the cover panel of an insulating element are made of wood. These materials are relatively easy to source pretty much worldwide and are attractive in terms of cost. In addition, the use of a flexible substance makes it easier to construct the insulating layer in all regions of the tank.

Such a tank may form part of an on-shore based storage facility, for example for storing LNG or may be installed in a coastal or deep-water off-shore floating structure, notably a methane tanker, a floating storage and regasification unit (FSRU), a floating production, storage and offloading unit (FPSO) or similar. The bearing structure is built on foundations fixed to continental or subsea ground. According to one embodiment, a ship for transporting a cold liquid product has a double hull and an aforementioned tank arranged in the double hull.

According to one embodiment, the invention also provides a method for loading or offloading such a ship, in which method a cold liquid product is conveyed through insulated piping from or to a floating or on-shore storage facility to or from the tank of the ship.

According to one embodiment, the invention also provides a system for transferring a cold liquid product, the system comprising the abovementioned ship, insulated piping designed to connect the tank installed in the hull of the ship to a floating or on-shore storage facility and a pump for causing the cold liquid product to flow through the insulated piping from or to the floating or on-shore storage facility to or from the tank of the ship.

One idea underlying the invention is that of providing a fluidtight and insulating wall structure at an advantageous cost and that requires a shorter assembly time.

Certain aspects of the invention are derived from the idea of the essential functions of the fluidtight and insulating tank wall being performed by several non-coupled structural elements, particularly that of providing a fine metallic membrane to perform the sealing function, a thermally insulating lagging to perform the thermal insulation function, a relatively continuous floor wall to support the membrane, bearing elements to react the hydrostatic pressure experienced by the membrane and the floor wall and a membrane anchoring system that holds the membrane on the bearing wall without any tensile load being transmitted through the floor wall or its bearing elements or the thermally insulating lagging. Thanks to the absence of coupling between the anchoring system and the insulating elements, the latter can be produced in a simple low-cost form, notably using a flexible non-structural insulator such as glass wool.

Certain aspects of the invention are derived from the idea of creating the wall structure in modular form.

Certain aspects of the invention are derived from the idea of making maximum use of standard materials available throughout the world.

The invention will be better understood and other objects, details, features and advantages thereof will become more clearly apparent during the course of the following description of a number of particular embodiments of the invention which are given solely by way of nonlimiting illustration with reference to the attached drawings.

Figure 1:
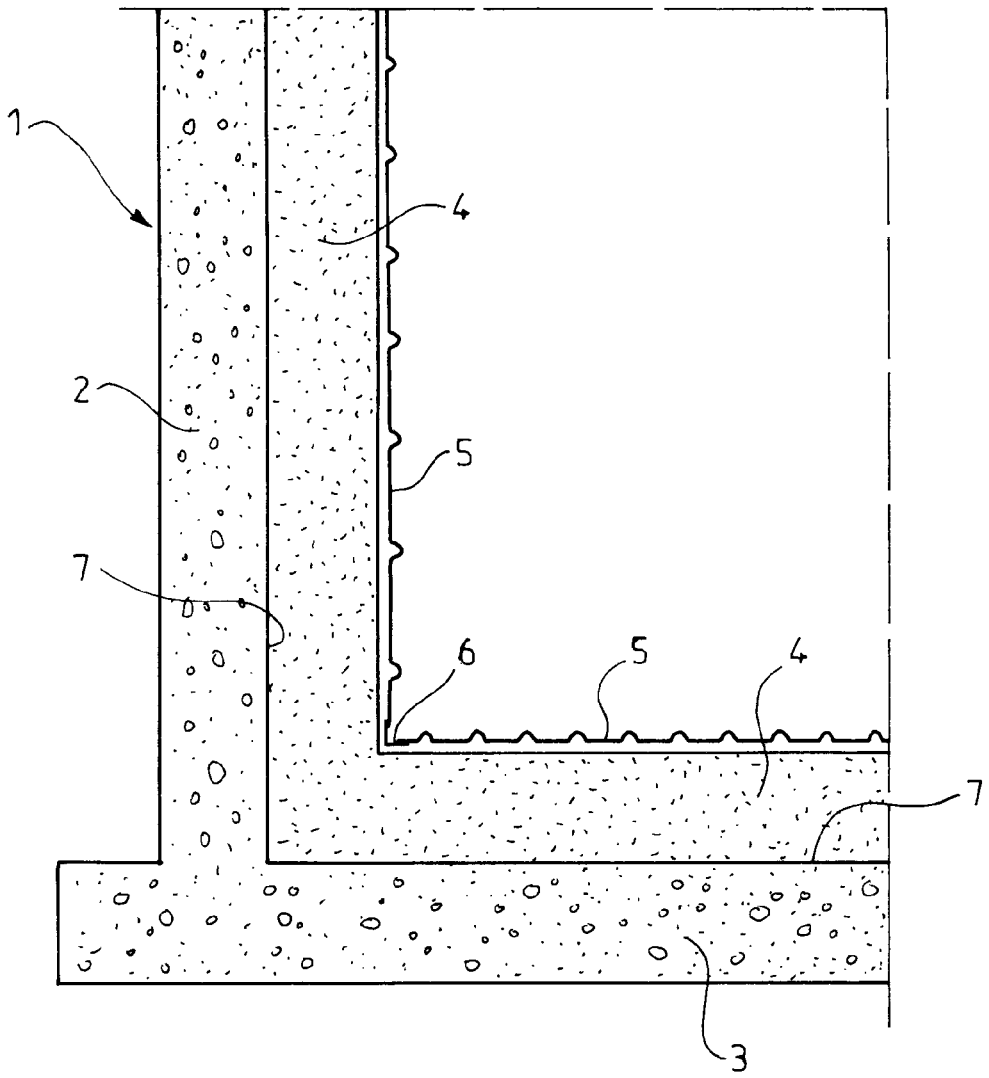
FIG. 1 is a cross-sectional partial schematic view of an on-shore liquefied natural gas tank.

FIG. 1 partially depicts an on-shore tank for the storage of liquefied gas. An on-shore tank means a tank the bearing structure 1 of which is built on foundations fixed to the ground, whether this be continental ground, shoreline ground or subsea ground. The bearing structure 1 may be constructed above ground level, or may be partially or fully buried.

The bearing structure 1 is made of concrete and comprises a peripheral wall 2 of cylindrical overall geometry and a bottom wall 3. For example, the peripheral wall 2 has an exterior surface of circular cross section and an interior surface of polygonal section.

The interior surface 7 of the bottom wall 3 and of the peripheral wall 2 is covered with a multi-layer structure depicted schematically in FIG. 1 and which comprises a thermally insulating barrier 4 and a metallic sealing membrane 5, that is both liquidtight and gastight. The fluidtight connection between the sealing membranes 5 of the bottom wall 3 and of the peripheral wall 2 is achieved by means of a metal angle bracket 6.

One embodiment of the thermally insulating barrier 4 is now described with reference to FIGS. 2 and 3. By convention, "above" here denotes a position situated closer towards the inside of the tank and "under" denotes a position situated closer to the bearing structure, regardless of the orientation of the wall in relation to the Earth's gravitational field.

Figure 2:
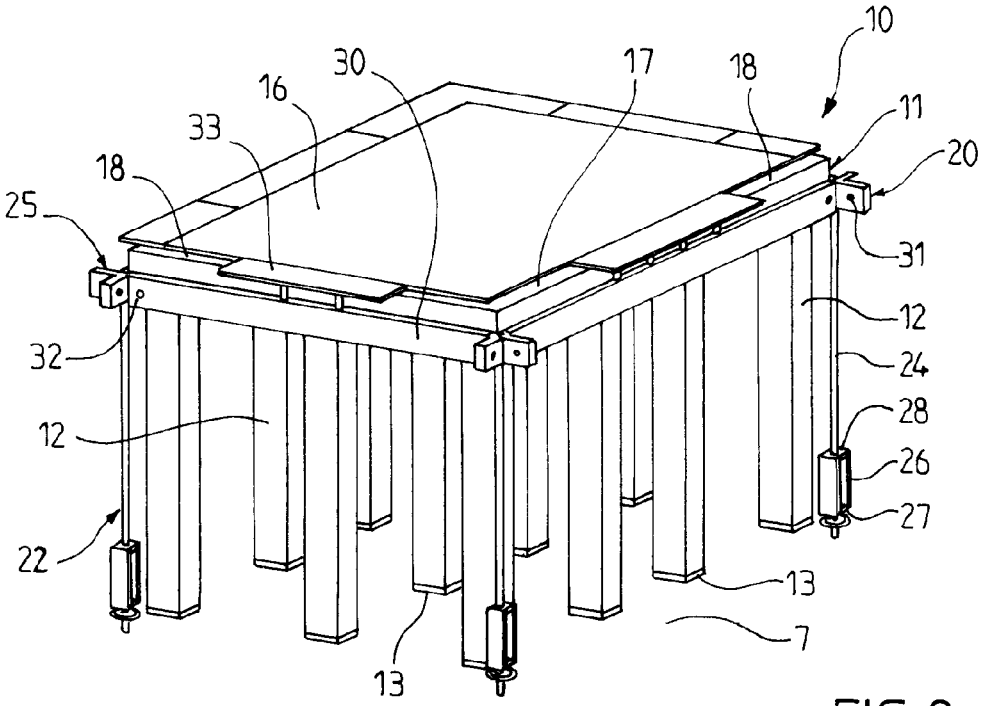
FIG. 2 is a perspective view of a modular unit that can be used in an insulating barrier of the tank of FIG. 1.

In this embodiment, the thermally insulating barrier 4 is produced in the form of a plurality of parallelepipedal insulating elements 10 which are juxtaposed on the interior surface 7, and one example of which is depicted in FIG. 2.

The insulating element 10 comprises a cover panel 11 of rectangular or square shape and a plurality of bearing posts 12 fixed to a lower face of the cover panel 11 perpendicular to this panel. The posts 12 rest against the surface 7 of the bearing structure. Mastic packing pieces 13 may be arranged at the ends of the posts 12 that press against the interior surface 7 so as to compensate for the unevenness of the surface 7 and thus align the cover panels 11 with a theoretical surface that offers great precision across the entire extent of the tank. This alignment encourages uniform support of the sealing membrane. The mastic packing pieces 13 are intended to work in compression and therefore need not have good adhesion properties.

The dimensions of the cover panel 11 and of the posts 12 and the spacing thereof are set according to the requirements of the intended application, particularly the hydrostatic pressure to be reacted and the materials chosen. For an embodiment using plywood, the plan may, for example, be to have a cover panel 11 that is 35 mm thick, posts 12 that measure 60×60 mm in cross section for a length of the order of one meter, and a separation of around 25 and 30 cm between two posts.

Figure 3:
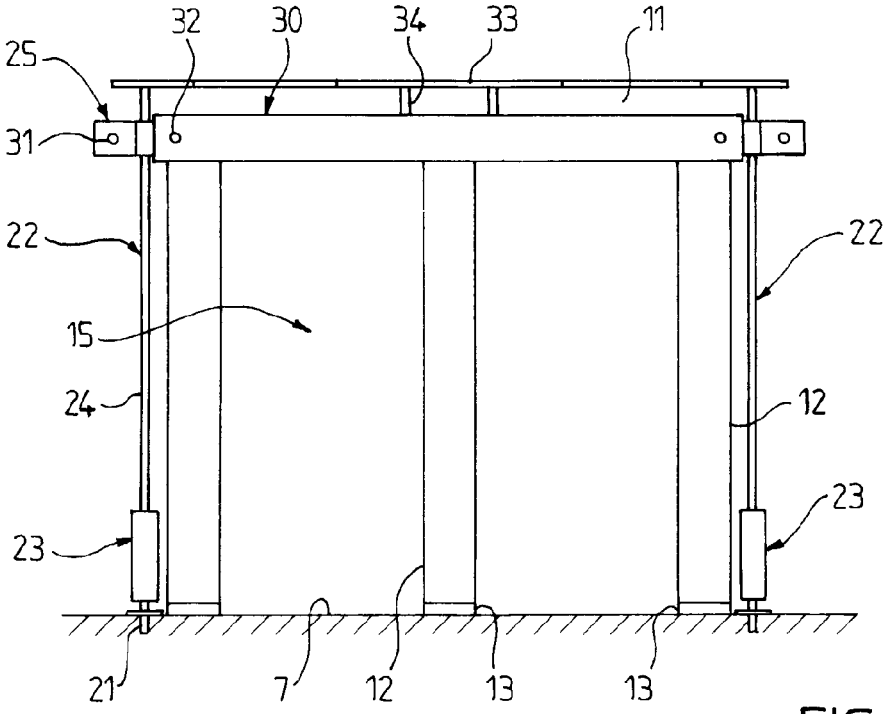
FIG. 3 is a two-dimensional side view of the modular unit of FIG. 2.

A non-structural insulating substance of the glass wool type, which has not been depicted in FIGS. 2 and 3, is positioned between the posts 12 so as to form an insulating layer that is substantially continuous across the entire extent of the interior surface 7 of the bearing structure and to fill more or less all of the space 15 between the cover panel 11 and the interior surface 7.

In order to hold the insulating element 10 on the bearing structure, an anchoring device 20 forms a surround all around the insulating element 10. The anchoring device 20 comprises four studs 21 which are permanently fixed into the bearing structure, for example set or screwed into the concrete, at the four corners of the insulating element 10. Each stud 21 bears an elongate coupler 22 which extends perpendicular to the surface 7.

Each coupler 22 comprises in succession an insulating section 23, to avoid creating too good a thermal bridge to the bearing structure, a metal rod 24 which extends as far as the top of the posts 12 and a cruciform connector 25 for attaching crossmember rods 30. The insulating section 23 in this instance is made up of two elongate sheets of wood 26 which are distant and parallel and connect a lower metal mounting plate 27 to an upper metal mounting plate 28 attached to the rod 24.

The cruciform connector 25 has four arms running parallel to the cover panel 11 at a corner 17 of the cover panel. Two arms run along the two adjacent sides of the cover panel 11 at this corner 17, and two more arms extend in the opposite directions to collaborate with adjacent insulating elements.

The crossmember rods 30 are fixed to the connectors 25 in such a way that a crossmember rod 30 extends along each side of the cover panel 11, in each instance between two connectors 25 the arms of which fit into housings provided at the two ends of the crossmember rod 30. A fastening device may be provided to hold the crossmember rod 30 on the connector 25. In the example depicted, drillings 31 in the arm of the connector 25 and corresponding drillings 32 in the end of the crossmember rod 30 accept pins, not depicted, to achieve this attachment.

The crossmembers 30 thus create a surround which surrounds the cover panel 11 and is held on the bearing structure by the couplers 22. The crossmembers 30 serve to hold both the insulating element 10 and the underlying membrane on the bearing structure.

To do that, each crossmember 30 bears an anchor plate 33, situated approximately midway along it, which runs parallel to the cover panel 11 and is exactly flush with the upper surface 16 of the cover panel 11. The anchor plate 33 is attached to the upper edge of the crossmember 30 by fixing screws 34. The anchor plate 33 protrudes on each side of the crossmember 30 to collaborate with the cover panels 11 of two insulating elements 10 which are arranged one on each side of the crossmember 30. In order to accommodate the protruding portion of the anchor plate 33, the edge of the cover panel 11 in each instance has a spot face 18 of a depth equal to the thickness of the anchor plate 33. As may be seen in FIG. 2, the insulating element 10 is therefore held on the bearing structure by four anchor plates 33 engaging with each of its four sides.

Figure 4:
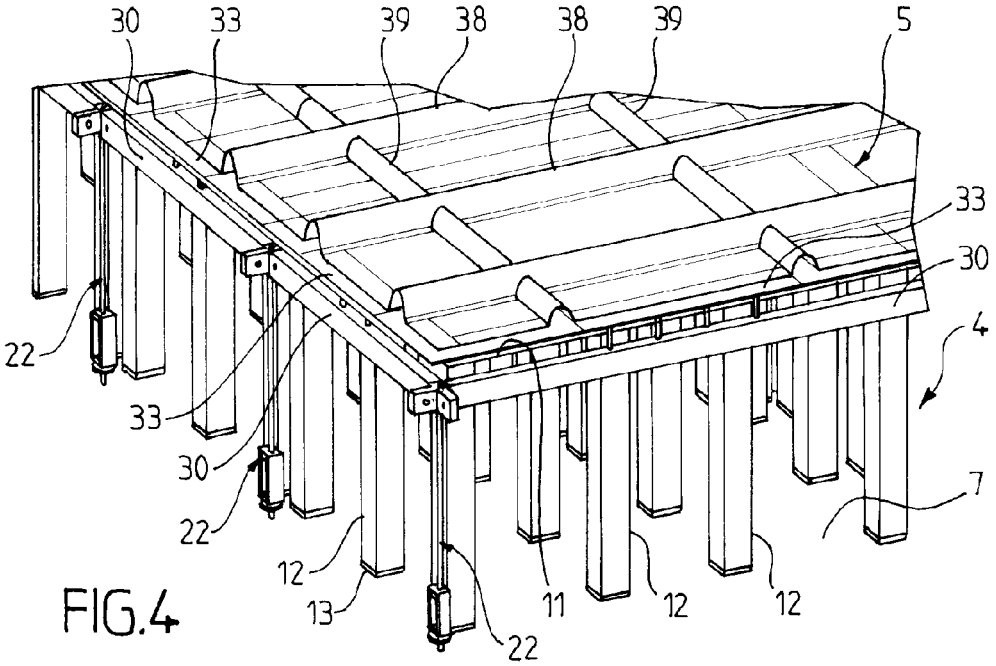
FIG. 4 is a perspective view with cutaway of a simple fluidtight and insulating wall produced using the modular unit of FIG. 2.

FIG. 4 depicts the tank wall obtained after the metallic membrane 5 has been laid on the insulating barrier 4, which is formed by repeating the structure described hereinabove across the entire extent of one wall of the tank, i.e. by forming a periodic rectangular tiling pattern of the plane.

The metallic membrane 5 here is formed of a fine stainless steel sheet having a network of secant corrugations 38 and 39 giving it elasticity in all directions of the plane. This membrane is built up of rectangular metal sheets which are placed on the cover panels 11 of the juxtaposed insulating elements 10 and which are welded to the anchor plates 33 at the edges of each rectangular metal sheet. For that, the dimensions of the rectangular metal sheets are determined so that they correspond to a whole multiple of the dimensions of a cover panel 11. In addition, these dimensions preferably correspond to a whole multiple of the wavelength of the corrugations, for example to an elemental pattern of at least two wavelengths of the first corrugations 38 and at least two wavelengths of the second corrugations 39. According to one embodiment, the wavelengths of the corrugations 38 and 39 are 340 mm and 503 mm respectively. If the rectangular metal sheet is larger than the cover panel 11, the anchor plates 33 that do not correspond to the edges of the rectangular metal sheet support this sheet without being welded to it.

Using the known technique, the rectangular metal sheets are welded together with overlap to form the sealed membrane across the entire wall of the tank. Thanks to the anchor plates 33, the metallic membrane 5 is held reliably on the cover panels 11 without it being liable to transmit any tensile loading to the insulating elements 10, because such loadings are reacted directly by the anchoring device 20, namely the crossmembers 30 and the couplers 22.

The steps involved in constructing the above tank wall are, schematically, as follows:

- The periodic rectangular tiling pattern is marked out on the bearing wall that is to be covered
- The studs 21 are fitted at each node in the tiling pattern
- The couplers 22 are installed on the studs 21 and adjusted in height
- The crossmembers 30 are installed and fastened using the pins
- The insulating elements 10, preferably obtained as prefabricated elements and incorporating the wooden structure, the glass wool lagging and the mastic pads are installed
- The insulating elements 10 are locked in position by fitting the anchor plates 33, fixed by means of the screws 34 followed by a spot weld.

The tank wall described hereinabove is a simple wall. In another embodiment, the tank comprises a double wall including two fluidtight barriers alternating with two insulating barriers. For that, one possibility is to combine the first wall structure depicted in FIG. 4 with a second fluidtight and insulating barrier arranged either above or under this first wall structure. This second fluidtight and insulating barrier can be produced in various ways.

Figure 5:
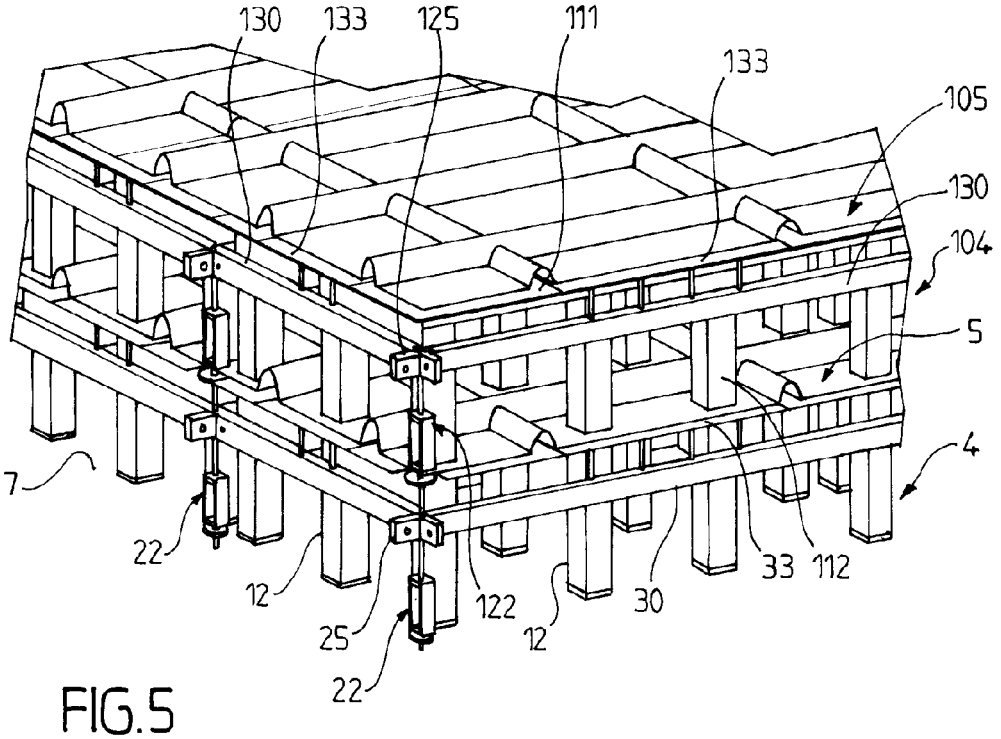
FIG. 5 is a perspective view with cutaway of a double fluidtight and insulating wall produced using the modular unit of FIG. 2.

According to an embodiment depicted in FIG. 5, the second fluidtight and insulating barrier is produced in the same way as the first. In FIG. 5, the wall structure identical to that of FIG. 4 constitutes a secondary barrier of the tank. A primary barrier produced in the same way is arranged on the secondary barrier. The elements of the secondary barrier bear the same reference numerals as in FIG. 4. The elements of the primary barrier which are identical or analogous to the elements of the secondary barrier bear the same reference numerals increased by the number 100.

It will be noted that the primary coupler 122 is, in each instance, fixed to the end of an underlying secondary coupler 22. The positions of primary posts 112 are chosen so that they rest between the corrugations of the secondary membrane 5. The primary coupler 122 is fixed to the end of the secondary coupler 22 passing through the secondary membrane 5 through a perforation therein. Continuity of the secondary membrane 5 is re-established using fluidtight connectors, for example an annular collar arranged on the primary coupler 122 above the secondary membrane 5 and the peripheral edge of which is welded or bonded to the secondary membrane 5 all around the perforation made.

FIG. 5 depicts a tank wall in which the primary barrier and the secondary barrier are produced in the same way. As an alternative, one of these two barriers could be produced in a different way from the other. In an alternative form of the embodiment the secondary membrane is not produced using stainless steel sheet but using another, less expensive, material, for example a composite material comprising a metallic foil bonded to one or more fibreglass mats by a polymer binder.

Figure 6:
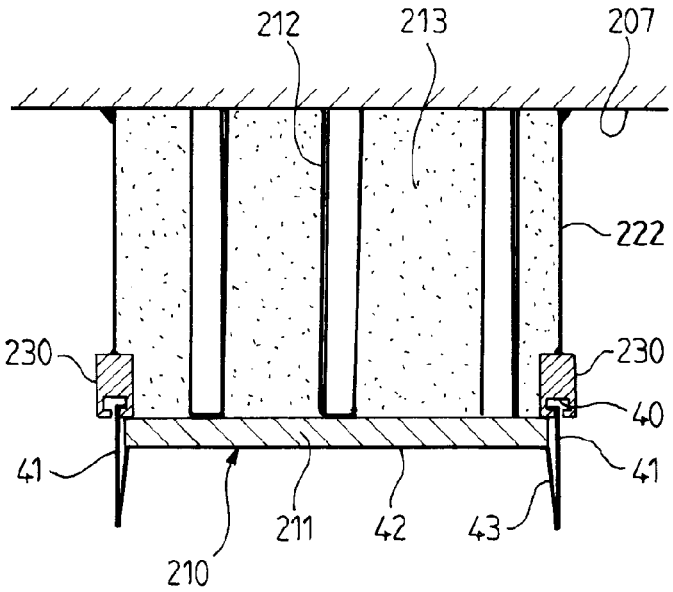
FIG. 6 is a view in cross section of another fluidtight and insulating wall produced using modular units.

Another embodiment of the tank wall will now be described with reference to FIGS. 6 et 7. Elements analogous or identical to those of FIGS. 2 to 4 bear the same reference numeral increased by 200.

This embodiment is particularly suited to coating the peripheral wall 2 with a fluidtight membrane 205 made of steel strakes with a low coefficient of expansion oriented in the vertical direction of the wall, in a similar way to FIG. 5 of the already mentioned FR-A-2739675.

To do that, the insulating element 210 is produced in exactly the same way as the insulating element 10. However, on two sides of the insulating element 210 which are oriented in the vertical direction of the wall, the anchor plates are omitted and the crossmembers 230 are modified to allow an elongate weld support 41 to be attached all along the wall of the tank in the vertical direction. This weld support 41 is a metal flange the bent-over base of which is inserted into a T-section slot 40 formed in the crossmember 230. This slot 40 is also extended through the cruciform connectors which have not been depicted.

Figure 7:
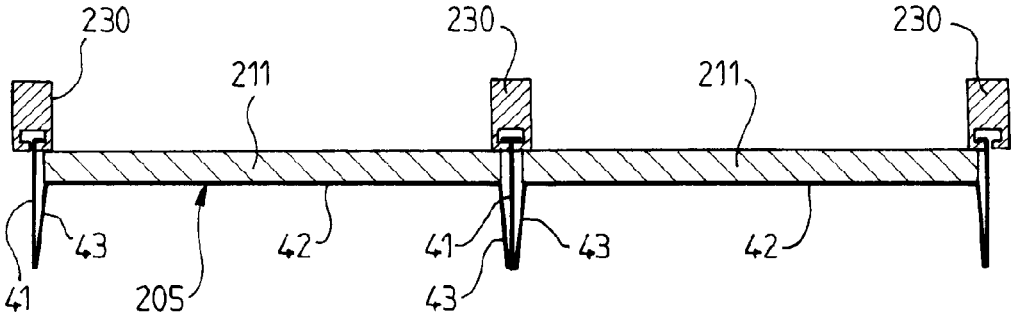
FIG. 7 is a view in cross section of a fluidtight barrier of the tank wall of FIG. 6.

A metal strake 42 with two turned-up edges 43 is, in each instance, positioned on the cover panels 211 of the insulating elements 210 forming a vertical row and welded continuously to the weld support 41 arranged on each side, so that the turned-up edges 43 form fluidtight gussets that can be deformed in the transverse direction. FIG. 7 schematically shows the membrane 205 thus obtained with two adjacent rows of strakes 42.

The strake 42 is simply rested on the anchor plates (not depicted) which remain at the horizontal edges of the cover panels 211, without being welded to these anchor plates, so that they can slide under the effect of thermal contraction. To compensate for thermal contraction in the vertical direction, a gusset which has not been depicted may be positioned at the closure of the primary membrane right at the top of the peripheral wall 2.

The technique described hereinabove for creating a fluidtight and insulating wall can be used in various types of reservoir, for example in an on-shore facility or in a floating construction such as a methane tanker ship or the like.

According to a corresponding embodiment, a fluidtight and insulating tank of prismatic overall shape is mounted in the double hull of a methane tanker ship. The wall of the tank comprises a primary fluidtight barrier intended to be in contact with the LNG contained in the tank, a secondary fluidtight barrier arranged between the primary fluidtight barrier and the double hull of the ship, and two insulating barriers arranged respectively between the primary fluidtight barrier and the secondary fluidtight barrier and between the secondary fluidtight barrier and the double hull.

In a way known per se, loading/offloading piping arranged on the upper deck of the ship may be connected, using suitable connectors, to a maritime or port terminal to transfer a cargo of LNG from or to the tank.

For example, such a maritime terminal comprises a loading and offloading station, an underwater pipe and an on-shore facility. The loading and offloading station is an off-shore fixed facility comprising a mobile arm and a tower supporting the mobile arm. The mobile arm bears a bundle of insulated flexible hoses that can be connected to the loading/offloading piping. The orientable mobile arm adapts to suit all sizes of methane tanker. A connecting pipe which has not been depicted extends up inside the tower. The loading and offloading station allows the methane tanker to be loaded and offloaded from or to the on-shore facility. This facility comprises liquefied gas storage tanks and connecting pipes which are connected by the underwater pipe to the loading or offloading station. The underwater pipe allows liquefied gas to be transferred between the loading or offloading station and the on-shore facility over a long distance, for example 5 km, allowing the methane tanker ship to remain a long distance away from the coastline during the loading and offloading operations.

In order to generate the pressure needed for transferring the liquefied gas, use is made of pumps carried on board the ship and/or of pumps with which the on-shore facility is equipped and/or of pumps with which the loading and offloading station is equipped.

Although the invention has been described in conjunction with a number of particular embodiments, it is quite obvious that it is not in any way restricted thereto and that it comprises all technical equivalents of the means described and combinations thereof where these fall within the scope of the invention.

The use of the verb "comprise", "have" or "include" and the conjugated forms thereof does not exclude the presence of other elements or other steps than those listed in a claim. The use of the indefinite article "a" or "an" or even "one" in an element or a step does not, unless specified otherwise, exclude there being a plurality of such elements or steps.

In the claims, any reference symbol between parentheses cannot be interpreted as a limitation of the claim.

The invention claimed is:

1. Fluidtight and thermally insulating tank built into a bearing structure (1) to contain a fluid, in which one wall of the tank comprises:

a bearing wall (2, 3) of the bearing structure, a multi layer structure comprising a fluidtight barrier (5, 105, 205) and a thermally insulating barrier (4, 104) which is arranged between the fluidtight barrier and the bearing wall, the thermally insulating barrier comprising juxtaposed insulating elements (10, 110, 210), an insulating element including:

thermally insulating lagging material arranged in the form of a layer parallel to the bearing wall, bearing elements (12, 112, 212) which rise up through the thickness of the thermally insulating lagging material to react compressive loads, and a cover panel (11, 111, 211) placed on the bearing elements and having a support surface (16) parallel to the bearing wall for supporting the fluidtight barrier, and retaining rods (22, 122, 222) attached to the bearing wall between the insulating elements and extending in the direction of the thickness of the multi layer structure to hold the multi layer structure on the bearing wall, in which crossmembers (30, 130, 230) are attached to the retaining rods (22, 122, 222) such that in each instance a crossmember extends between two retaining rods at the interface between two insulating elements, characterized in that:

an anchor plate (33, 133) is arranged in line with the interface between two insulating elements, connected with the crossmember (30, 130) so as to lie flush with the cover panel (11, 111) of an adjacent insulating element, the anchor plate having a lower surface which bears against an edge of the cover panel and an upper surface on which the fluidtight barrier (5, 105) is placed, so that:

the cover panel (11, 111, 211) that covers the insulating elements is connected to the crossmember (30, 130, 230) by the anchor plate so as to be held against the bearing wall via the crossmember, and the fluidtight barrier (5, 105, 205) is connected to the crossmember (30, 130, 230) by the anchor plate so as to be held against the cover panels that cover the insulating element via the crossmember.

2. Tank according to claim 1, in which the anchor plate (33, 133) protrudes in each side of the crossmember (30, 130) parallel to the bearing wall so as to collaborate with the cover panels (11, 111) of the two insulating elements between which the crossmember is arranged.

3. Tank according to claim 1, in which the anchor plate (33, 133) is arranged midway between the two retaining rods (22, 122) to which the crossmember is attached.

4. Tank according to claim 1, in which the fluidtight barrier (5, 105) comprises a metallic membrane having corrugations and flat parts situated between the corrugations, the anchor plates (33, 133) being made of metal, the metallic membrane being welded to the anchor plates at the flat parts.

5. Tank according to claim 1, in which the retaining rods (222) are arranged in such a way as to form a plurality of parallel rows on the bearing wall, and in which the crossmembers (230) which extend between the retaining rods of one row each bear an elongate weld support (41) which protrudes at right angles to the bearing wall between the cover panels (211) of the insulating elements (210) adjacent to the row of retaining rods, and in which the fluidtight barrier (205) comprises a metallic membrane made of a nickel steel with a thermal coefficient of expansion lower than $3.10^{-6}$ $K^{-1}$ at ambient temperature, which is made up of flat strips (42) of sheet metal arranged on the cover panels (211) of the insulating elements and having edges (43) that are turned up towards the inside of the tank, the turned up edges of the strips of sheet metal being welded continuously to the elongate weld supports to form deformable gussets capable of deforming in a direction transverse to the elongate weld supports.

6. Tank according to claim 1, in which the multi layer structure (104, 105) constitutes a primary barrier of the tank, the tank wall further comprising a second multi layer structure (4, 5) arranged between the first multi layer structure (104, 105) and the bearing wall, the second multi layer structure (4, 5) comprising a secondary fluidtight barrier and a secondary thermally insulating barrier which is arranged between the secondary fluidtight barrier and the bearing wall, and in which the insulating elements (104) of the primary barrier bear against the secondary fluidtight barrier.

7. Tank according to claim 6, in which the secondary insulating barrier (4, 5) comprises juxtaposed secondary insulating elements (10), a secondary insulating element including:

thermally insulating lagging material arranged in the form of a layer parallel to the bearing wall, bearing elements (12) which rise up through the thickness of the thermally insulating lagging material to react compressive loads, and a cover panel (11) placed on the bearing elements and having a support surface parallel to the bearing wall for supporting the secondary fluidtight barrier, and in which the retaining rods (22) attached to the bearing wall (2, 3) extend between the secondary insulating elements (10) in the direction of the thickness of the second multi layer structure to hold the second multi layer structure also on the bearing wall, in which secondary crossmembers (30) are attached to the retaining rods such that in each instance a secondary crossmember extends between two retaining rods at the interface between two secondary insulating elements (10), the cover panels (11) of the secondary insulating elements being connected to the secondary crossmembers (30) so as to be held against the bearing wall via the secondary crossmembers, and the secondary fluidtight barrier (5) being connected to the secondary crossmembers (30) so as to be held against the cover panels of the secondary insulating elements via the secondary crossmembers, the secondary fluidtight barrier (5) having the retaining rods (22, 122) attached to the bearing wall passing through it and having fluidtight connections around the retaining rods.

8. Tank according to claim 1, in which the multi layer structure (4, 5) constitutes a secondary barrier of the tank, the tank wall further comprising a second multi layer structure arranged on the first multi layer structure (4, 5) on the opposite side to the bearing wall, the second multi layer structure comprising a primary fluidtight barrier (105) and a primary thermal insulation barrier (106) which is arranged between the primary fluidtight barrier and the secondary fluidtight barrier.

9. Tank according to claim 7, in which the secondary fluidtight barrier (5) is made of a composite material comprising a metal foil and a fibreglass mat bonded to the metal foil by a polymer resin.

10. Tank according to claim 1, in which a retaining rod (22, 122, 222) bears a crossmember connector (25, 125) arranged at a level lower down than the cover panels (11, 111, 211) of the insulating elements, the crossmember connector comprising several fasteners arranged around the retaining rod to collaborate with complementary fasteners arranged at the ends of the crossmembers (30, 130, 230).

11. Tank according to claim 1, in which the bearing elements (12, 112, 212) comprise posts, the cross section of which is smaller than a length of the insulating element.

12. Tank according to claim 1, in which the thermally insulating lagging comprises a flexible insulating substance.

13. Tank according to claim 1, in which the bearing elements (12, 112, 212) and the cover panel (11, 111, 211) of an insulating element are made of wood.

14. Tank according to claim 1, in which the bearing structure (1) is built on foundations fixed to continental or subsea ground.

15. Ship for transporting a liquid product, the ship comprising a double hull and a tank according to claim 1 arranged in the double hull, the double hull forming the bearing structure of the tank.

16. Method of using a ship according to claim 15, in which method a liquid product is conveyed through insulated piping from or to a floating or on shore storage facility to or from the tank of the ship in order to load or offload the ship.

17. System for transferring a liquid product, the system comprising a ship according to claim 15, insulated piping designed to connect the tank installed in the hull of the ship to a floating or on shore storage facility and a pump for causing the liquid product to flow through the insulated piping from or to the floating or on-shore storage facility to or from the tank of the ship.

* * * * *